US010267129B1

(12) United States Patent
Sun et al.

(10) Patent No.: US 10,267,129 B1
(45) Date of Patent: Apr. 23, 2019

(54) HOMOCENTRIC SQUARES-SHAPED WELL STRUCTURE FOR MARINE HYDRATE RESERVE RECOVERY UTILIZING GEOTHERMAL HEAT AND METHOD THEREOF

(71) Applicant: CHINA UNIVERSITY OF PETROLEUM (EAST CHINA), Shandong (CN)

(72) Inventors: Baojiang Sun, Shandong (CN); Ye Chen, Shandong (CN); Zhiyuan Wang, Shandong (CN); Litao Chen, Shandong (CN); Yonghai Gao, Shandong (CN); Jiafang Xu, Shandong (CN); Heen Zhang, Shandong (CN)

(73) Assignee: CHINA UNIVERSITY OF PETROLEUM (EAST CHINA) (CN)

( * ) Notice: Subject to any disclaimer, the term of this patent is extended or adjusted under 35 U.S.C. 154(b) by 0 days.

(21) Appl. No.: 16/058,623

(22) Filed: Aug. 8, 2018

(30) Foreign Application Priority Data

May 14, 2018 (CN) ..... 2018 1 0454977

(51) Int. Cl.
*E21B 43/24* (2006.01)
*E21B 43/38* (2006.01)
*E21B 34/06* (2006.01)

(52) U.S. Cl.
CPC ..... *E21B 43/24* (2013.01); *E21B 43/385* (2013.01); *E21B 34/06* (2013.01)

(58) Field of Classification Search
CPC ..... E21B 43/2406; E21B 43/17
See application file for complete search history.

(56) References Cited

U.S. PATENT DOCUMENTS 4,200,152 A * 4/1980 Foster ..... E21B 41/005 166/271
6,948,562 B2 * 9/2005 Wellington ..... E21B 7/04 137/13
7,647,972 B2 * 1/2010 Kaminsky ..... E21B 36/001 166/302
8,087,460 B2 * 1/2012 Kaminsky ..... E21B 36/04 166/245
8,091,632 B2 * 1/2012 Diehl ..... E21B 43/2401 166/248

(Continued)

FOREIGN PATENT DOCUMENTS

FR 2992327 A1 * 12/2013 ..... E21B 43/20

*Primary Examiner* — Matthew R Buck
*Assistant Examiner* — Aaron L Lembo
(74) *Attorney, Agent, or Firm* — Calfee, Halter & Griswold LLP

(57) ABSTRACT

The present invention relates to the field of marine hydrate reserve recovery technology, and discloses a homocentric squares-shaped well structure for marine hydrate reserve recovery utilizing geothermal heat and a method thereof. The present invention employs a homocentric squares-shaped well structure and utilizes heat-carrying fluid to transfer the energy in a geothermal reservoir to a hydrate reservoir to promote dissociation of natural gas hydrates. The homocentric squares-shaped well structure can realize cyclic utilization of the heat-carrying fluid while improving heat conduction efficiency, and has advantages including high recovery rate, low recovery cost, low energy loss, and high heat utilization efficiency, etc.

12 Claims, 1 Drawing Sheet

(56) References Cited

U.S. PATENT DOCUMENTS

| | | | | |
|---|---|---|---|---|
| 8,622,127 | B2 * | 1/2014 | Kaminsky | E21B 43/2401 166/245 |
| 8,869,891 | B2 * | 10/2014 | Berg | E21B 43/16 166/261 |
| 9,309,473 | B2 * | 4/2016 | McAlister | B01J 7/00 |
| 2004/0200618 | A1 * | 10/2004 | Piekenbrock | E21B 41/0057 166/305.1 |
| 2005/0252656 | A1 * | 11/2005 | Maguire | E21B 43/247 166/256 |
| 2016/0369571 | A1 * | 12/2016 | Banerjee | E21B 43/2406 |

* cited by examiner

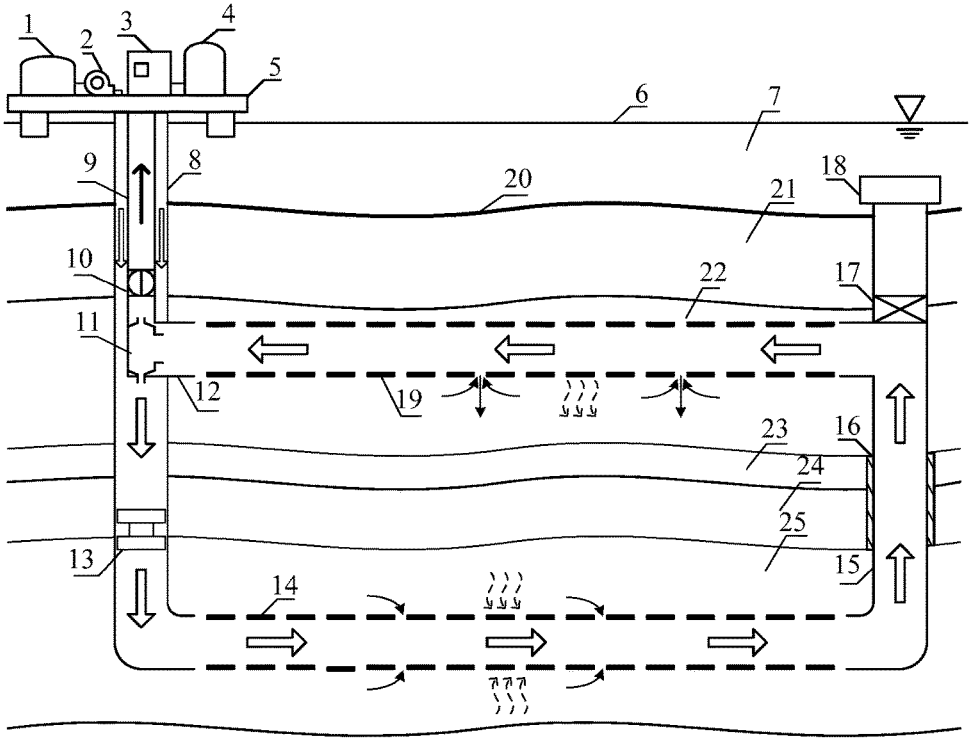
1
2
3
4
5
6
7
8
9
10
11
12
13
14
15
16
17
18
19
20
21
22
23
24
25

HOMOCENTRIC SQUARES-SHAPED WELL STRUCTURE FOR MARINE HYDRATE RESERVE RECOVERY UTILIZING GEOTHERMAL HEAT AND METHOD THEREOF

CROSS REFERENCE TO RELATED APPLICATIONS

This application claims priority to Chinese Application No. 201810454977.9, filed on May 14, 2018, entitled "Homocentric Squares-Shaped Well Structure for Marine Hydrate Reserve Recovery Utilizing Geothermal Heat and Method Thereof", which is specifically and entirely incorporated by reference.

FIELD OF THE INVENTION

The present invention relates to the field of marine hydrate reserve recovery technology, in particular to a homocentric squares-shaped well structure for marine hydrate reserve recovery utilizing geothermal heat and a method for marine hydrate reserve recovery utilizing geothermal heat.

BACKGROUND OF THE INVENTION

Natural gas hydrates are cage-type complex compounds, and have characteristics including abundant reserve, wide distribution, high energy density, and clean combustion, etc. Therefore, natural gas hydrates are regarded as a new alternative energy resource that has high potential in the twenty-first century. Natural gas hydrates are formed by small molecular gasses bonded with water molecules under high pressure and low temperature, and the small molecular gasses mainly include hydrocarbon gasses, such as methane and ethane, etc. It is found in the researches over the years: the natural gas hydrates in the nature are mainly distributed in polar tundra in high-latitude regions and in deep sea beds, continental slopes, continental rises, and ocean trenches around the world, wherein, the natural gas reserve occurred in marine hydrates is estimated to be $20\times10^{15}$ $m^3$. Therefore, it is of far reaching importance to exploit and utilize marine hydrate resources rationally to mitigate the energy crisis and enrich the energy structure.

Up to now, relatively matured hydrate recovery methods mainly include thermal stimulation, depressurization, chemical inhibitor injection, and carbon dioxide ($CO_2$) replacement. Wherein, the depressurization is usually applied to change the phase equilibrium of the hydrates by decreasing the pressure in the reservoir system, and thereby induce the dissociation of natural gas hydrate with the advantages including low cost, easy operation, and low energy loss. However, it is too slow for commercial exploitation and hard to be controlled. Chemical inhibitor injection is to inject chemical agents, such as alcohols and brines, etc., to drive the natural gas hydrate to decompose with the advantages including easy and simple operation and significant effect. However, it cost too much and always pollutes the environment. Carbon dioxide ($CO_2$) replacement is to use $CO_2$ to replace methane gas in the natural gas hydrate by utilizing a fact that $CO_2$ can form hydrates more easily than $CH_4$, and it has advantages that double benefits are gained (i.e., the greenhouse gas $CO_2$ is sequestrated while the natural gas is recovered) and the stability of the reservoir is maintained at the same time, but has drawbacks including low cost-performance and low exploitation rate. Thermal stimulation usually is to increase the temperature of the reservoir system by injecting hot fluid or by electromagnetic heating, and thereby drive the natural gas hydrates to decompose, and it has advantages including convenient operation, high exploitation rate and high controllability, but has drawbacks including high cost, high energy loss, and low heat utilization efficiency.

Therefore, it is desirable to develop an apparatus and a method for marine hydrate reserve recovery, which have advantages including high exploitation rate, low production cost, low energy loss, and high heat utilization efficiency.

SUMMARY OF THE INVENTION

The object of the present invention is to provide a homocentric squares-shaped well structure and a method for marine hydrate reserve recovery utilizing geothermal heat, which have advantages including high recovery rate, low recovery cost, low energy loss, and high heat utilization efficiency, etc.

To attain the object described above, in one aspect, the present invention provides a homocentric squares-shaped well structure for marine hydrate reserve recovery utilizing geothermal heat, which comprises: an injection well arranged to extend from the ocean surface to a geothermal reservoir and configured to inject heat-carrying fluid; a heat extraction well disposed inside the geothermal reservoir, with an inlet end of the heat extraction well in communication with an outlet end of the injection well, the heat extraction well is configured to convey the heat-carrying fluid so that the heat-carrying fluid extracts heat from the geothermal reservoir; a circulation well arranged to extend from the geothermal reservoir to a hydrate reservoir, with an inlet end of the circulation well in communication with an outlet end of the heat extraction well;

a heat release and collection well disposed in the hydrate reservoir, with an inlet end of the heat release and collection well in communication with an outlet end of the circulation well, the heat release and collection well is configured to release the heat-carrying fluid to the hydrate reservoir and collect dissociation products in the hydrate reservoir at the same time; and a production pipeline fitted in the injection well, with a radial clearance formed between the production pipeline and the injection well, the production pipeline is arranged to extend from the ocean surface to the hydrate reservoir, with an inlet end of the production pipeline extending out of the injection well and in communication with an outlet end of the heat release and collection well, a gas-liquid separator is disposed in the production pipeline and configured to block the direct communication between the inlet end and the outlet end of the production pipeline, wherein, an inlet of the gas-liquid separator is in communication with the inlet end of the production pipeline, a liquid outlet of the gas-liquid separator is in communication with the injection well, and a gas outlet of the gas-liquid separator is in communication with the outlet end of the production pipeline.

Preferably, a check valve configured to prevent the gas from flowing back into the gas-liquid separator is disposed in the production pipeline.

Preferably, the injection well and the circulation well are vertical wells, and/or the heat extraction well and the heat release and collection well are horizontal wells.

Preferably, the central axis of the heat release and collection well is at a distance equal to ⅓-¼ of the thickness of the hydrate reservoir from the top surface of the hydrate reservoir.

Preferably, the heat extraction well and the heat release and collection well are both screen pipes; and/or the homocentric squares-shaped well structure comprises a pressurizing device configured to provide circulation power for the heat-carrying fluid.

Preferably, the homocentric squares-shaped well structure includes an ocean platform disposed above the injection well, wherein, the ocean platform is equipped with a processing station in communication with the outlet end of the production pipeline and a natural gas recovery bunker in communication with the processing station.

Preferably, an intermediate formation exists between the hydrate reservoir and the geothermal reservoir, and an insulating sleeve is fitted over the portion of the circulation well in the intermediate formation.

In another aspect, the present invention provides a method for marine hydrate reserve recovery utilizing geothermal heat, which comprises:

S1: injecting heat-carrying fluid into a geothermal reservoir, and driving the heat-carrying fluid to extract heat from the geothermal reservoir and then flow to a hydrate reservoir, to promote dissociation of natural gas hydrates in the hydrate reservoir;

S2: treating the dissociation product in the hydrate reservoir by gas-liquid separation, recovering the gas product, injecting the liquid product into the geothermal reservoir so that the liquid product is circulated with the heat-carrying fluid as in step S1.

Preferably, the step S2 further comprises transferring the heat carried by the gas product to the heat-carrying fluid to be injected into the geothermal reservoir in the gas product recovery process.

Preferably, the method is employed by using the homocentric squares-shaped well structure described above.

The present invention employs a homocentric squares-shaped well structure to connect a geothermal reservoir to a hydrate reservoir and utilizes heat-carrying fluid to transfer the energy in the geothermal reservoir to the hydrate reservoir to promote dissociation of natural gas hydrates. The homocentric squares-shaped well structure can realize cyclic utilization of the heat-carrying fluid while improving heat conduction efficiency, and has advantages including high recovery rate, low recovery cost, low energy loss, and high heat utilization efficiency, etc.

Other features and advantages of the present invention will be further detailed in the embodiments hereunder.

BRIEF DESCRIPTION OF DRAWINGS

The accompanying drawings are provided here to facilitate further understanding on the present invention, and constitute a part of this document. They are used in conjunction with the following embodiments to explain the present invention, but shall not be comprehended as constituting any limitation to the present invention. In the figures:

FIG. 1 is a schematic structural diagram of an embodiment of the homocentric squares-shaped well structure according to the present invention.

BRIEF DESCRIPTION OF SYMBOLS

1—liquid recovery and storage tank; 2—circulating pump; 3—fine gas-liquid separation device; 4—natural gas recovery bunker; 5—ocean platform; 6—ocean surface; 7—marine layer; 8—injection well; 9—production pipeline; 10—check valve; 11—gas-liquid separator; 12—branch well head; 13—pressurizing device; 14—heat extraction well; 15—circulation well; 16—insulating sleeve; 17—packer; 18—circulation well head; 19—heat release and collection well; 20—mud line; 21—caprock; 22—hydrate reservoir; 23—sedimentary stratum; 24—stratum; 25—geothermal reservoir.

DETAILED DESCRIPTION OF THE EMBODIMENTS

Hereunder some embodiments of the present invention will be detailed with reference to the accompanying drawings. It should be understood that the embodiments described here are only provided to describe and explain the present invention, but shall not be deemed as constituting any limitation to the present invention.

In the present invention, unless otherwise specified, the terms that denote orientations are used as follows; for example, "top" and "bottom" usually refer to top and bottom in installation and operation states. "inside" and "outside" usually refers to inside and outside with respect to the outlines of the components.

In one aspect, the present invention provides a homocentric squares-shaped well structure for marine hydrate reserve recovery utilizing geothermal heat, which comprises: an injection well 8 arranged to extend from the ocean surface 6 to a geothermal reservoir 25 and configured to inject heat-carrying fluid; a heat extraction well 14 disposed inside the geothermal reservoir 25, with an inlet end of the heat extraction well 14 in communication with an outlet end of the injection well 8, the heat extraction well 14 is configured to convey the heat-carrying fluid so that the heat-carrying fluid extracts heat from the geothermal reservoir 25; a circulation well 15 arranged to extend from the geothermal reservoir 25 to a hydrate reservoir 22, with an inlet end of the circulation well 15 in communication with an outlet end of the heat extraction well 14; a heat release and collection well 19 disposed in the hydrate reservoir 22, with an inlet end of the heat release and collection well 19 in communication with an outlet end of the circulation well 15, the heat release and collection well 19 is configured to release the heat-carrying fluid to the hydrate reservoir 22 and collect dissociation products in the hydrate reservoir 22 at the same time; and a production pipeline 9 fitted in the injection well 8, with a radial clearance formed between the production pipeline 9 and the injection well 8, the production pipeline 9 is arranged to extend from the ocean surface 6 to the hydrate reservoir 22, with an inlet end of the production pipeline 9 extending out of the injection well 8 and in communication with an outlet end of the heat release and collection well 19, a gas-liquid separator 11 is disposed in the production pipeline 9 and configured to block the direct communication between the inlet end and the outlet end of the production pipeline 9, wherein, an inlet of the gas-liquid separator 11 is in communication with the inlet end of the production pipeline 9, a liquid outlet of the gas-liquid separator 11 is in communication with the injection well 8, and a gas outlet of the gas-liquid separator 11 is in communication with the outlet end of the production pipeline 9.

In the above description, it can be understood that the homocentric squares-shaped well structure forms a circulation path for the heat-carrying fluid to circulate, and thereby realizes cyclic utilization of the heat-carrying fluid. Specifically, the heat-carrying fluid flows through the injection well 8 into the heat extraction well 14, and then flows from the heat extraction well 14 through the circulation well 15 into the heat release and collection well 19; in the heat release and collection well 19, a part of the heat-carrying fluid is released to the hydrate reservoir 22 to increase the temperature of the system in the reservoir and promote dissociation of the natural gas hydrates; as the heat-carrying fluid is released and the natural gas hydrates are decomposed, the dissociation product flows into the heat release and collection well 19 under pressure and flows together with the remaining heat-carrying fluid via the inlet end of the production pipeline 9 into the gas-liquid separator 11 where gas liquid separation is carried out; the gas product obtained through the separation is discharged from the gas outlet of the gas-liquid separator 11 via the outlet end of the production pipeline 9 so that it is collected, and the liquid product obtained through the separation flows from the liquid outlet of the gas-liquid separator 11 into the injection well 8, and then enters into the next cycle together with the heat-carrying fluid in the injection well 8 (see FIG. 1). Through the above cycle, the natural gas hydrates are recovered quickly and stably.

In the above process, after the separation, the gas product and the liquid product have residual heat, wherein, the gas product may conduct heat to the injected fluid (i.e., heat-carrying fluid that is just injected from the inlet end of the injection well 8) in the radial clearance between the injection well 8 and the production pipeline 9 in the ascending process, and can avoid generation of secondary hydrates and blockage of the pipeline; the liquid product can enter into the injection well 8, participate in heat carrying, and transfer heat to the heat-carrying fluid by heat conduction and convection, and thereby the heat loss is reduced, and the heat is utilized efficiently.

With the above technical scheme, the homocentric squares-shaped well structure provided in the present invention can connect the geothermal reservoir 25 to the hydrate reservoir 22 and utilize heat-carrying fluid to transfer the energy in the geothermal reservoir 25 to the hydrate reservoir 22 to promote dissociation of natural gas hydrates. The homocentric squares-shaped well structure can realize cyclic utilization of the heat-carrying fluid while improving heat conduction efficiency, and has advantages including high recovery rate, low recovery cost, low energy loss, and high heat utilization efficiency, etc.

In addition, a filtering device (e.g., a filter screen) may be provided at the outlet end of the heat release and collection well 19 or the inlet end of the production pipeline 9 to filter off solid impurities (e.g., rock cuttings, etc.) trapped in the fluid collected by the heat release and collection well 19.

In the present invention, to prevent the gas discharged from the gas outlet of the gas-liquid separator 11 from flowing back into the gas-liquid separator 11, a check valve 10 configured to prevent the gas from flowing back into the gas-liquid separator 11 may be provided in the production pipeline 9. Wherein, the check valve 10 may be disposed at a location between the gas outlet of the gas-liquid separator 11 and the outlet end of the production pipeline 9, preferably disposed at a location near the gas outlet of the gas-liquid separator 11, as shown in FIG. 1, for example.

According to an embodiment of the present invention, as shown in FIG. 1, the injection well 8 and the circulation well 15 may be vertical wells. Here, it should be noted that the injection well 8 and the circulation well 15 may further include a horizontal section respectively besides a vertical section, such as an arrangement of branch well head 12, as shown in FIG. 1, to ease the installation and attain a better practical effect. In addition, the heat extraction well 14 and the heat release and collection well 19 may be horizontal wells. In that way, the heat extraction well 14 can easily collect energy by means of heat transfer by heat conduction and convection; the heat release and collection well 19 can release heat by means of heat transfer by heat conduction and convection easily, promote dissociation of the hydrates, and collect the dissociation product easily. Preferably, the heat extraction well 14 may be an extended-reach horizontal well, to increase the distance and time for energy exchange between the heat-carrying fluid and the geothermal heat, and thereby improve the heat carrying effect. The heat release and collection well 19 may also be an extended-reach horizontal well, to increase the distance and time for energy exchange between the heat-carrying fluid and the hydrates, and thereby improve the hydrate dissociation promotion effect.

Moreover, in the actual application, the circulation well 15 should be drilled from the circulation well head 18 shown in FIG. 1, and the top part of circulation channel in the circulation well 15 should be sealed with a packer 17. The circulation well head 18 should be kept in a closed state in the recovery process.

Wherein, preferably the central axis of the heat release and collection well 19 is at a distance equal to ⅓-¼ of the thickness of the hydrate reservoir 22 from the top surface of the hydrate reservoir 22. Such an arrangement can facilitate the hot fluid, which has higher density, to flow downward, and facilitate the gas, which has lower density, to flow upward, so that the gas can be collected easily.

In the present invention, both the heat extraction well 14 and the heat release and collection well 19 may be screen pipes. It can be understood that a plurality of through-holes are distributed in the wall of the screen pipe, and the fluid inside/outside the screen pipe can flow out of/into the screen pipe through the through-holes (see FIG. 1). By utilizing screen pipes, the heat conduction and convection between the fluid inside the pipe and the fluid outside the pipe can be enhanced, and thereby the heat transfer effect can be improved. Moreover, at certain flow speed of the fluid, low pressure may be produced locally in the screen pipe, and the raw hot fluid in the geothermal reservoir can flow into the screen pipe easily. Of course, the present invention is not limited to that scheme. Alternatively the heat extraction well 14 and the heat release and collection well 19 may employ any other pipeline that can implement the function.

In the present invention, the homocentric squares-shaped well structure may further comprise a pressurizing device 13 (e.g., a pressurizing pump) configured to provide circulation power for the heat-carrying fluid. The pressurizing device 13 may be disposed in all of the wells respectively (including the injection well 8, the heat extraction well 14, the circulation well 15, and the heat release and collection well 19), so as to pressurize to provide circulation power for the fluid if the fluid pressure in any of the wells is not enough.

In the present invention, preferably the heat-carrying fluid is water, water-based alcohol solution, or brine (an electrolyte solution that mainly contains chloride ions), etc.

Furthermore, in the actual application, to support the operations, including drilling of the homocentric squares-shaped well structure, injection of the heat-carrying fluid, and recovery of the gas product after the separation, the homocentric squares-shaped well structure may further comprise an ocean platform 5 disposed above the injection well 8, wherein, the ocean platform 5 is equipped with a processing station in communication with the outlet end of the production pipeline 9 and a natural gas recovery bunker 4 in communication with the processing station. Wherein, the natural gas recovery bunker 4 may be used to store and liquefy pure natural gas; moreover, the natural gas may be transported to another installation for utilization of the natural gas.

Wherein, the processing station is configured to process the gas product. The processing station may include various devices, such as fine gas-liquid separation device 3 (may be used to carry out finer gas-liquid separation of the gasses discharged from the outlet end of the production pipeline 9), liquid recovery and storage tank 1 (may be used to recover, store, and process the heat-carrying fluid), circulating pump 2 (may be used to draft the liquid product separated in the fine gas-liquid separation device 3 into the liquid recovery and storage tank 1 for processing, and then inject the processed liquid into the injection well 8 again).

In view that an intermediate formation exists between the hydrate reservoir 22 and the geothermal reservoir 25, to reduce the energy loss before the heat-carrying fluid is returned to the hydrate reservoir 22, an insulating sleeve 16 may be fitted over the portion of the circulation well 15 in the intermediate formation. Wherein, the intermediate formation refers to a combination of various strata between the hydrate reservoir 22 and the geothermal reservoir 25 in the ocean in the present situation. For example, as shown in FIG. 1, there are ocean surface 6, marine layer 7, mud line 20, caprock 21, hydrate reservoir 22, sedimentary stratum 23, stratum 24, and geothermal reservoir 25 distributed sequentially from top to bottom, wherein, the intermediate formation includes the sedimentary stratum 23 and the stratum 24.

In another aspect, the present invention provides a method for marine hydrate reserve recovery utilizing geothermal heat, which comprises:

S1: injecting heat-carrying fluid into a geothermal reservoir 25, and driving the heat-carrying fluid to extract heat from the geothermal reservoir 25 and then flow to a hydrate reservoir 22, to promote dissociation of natural gas hydrates in the hydrate reservoir 22;

S2: treating the dissociation product in the hydrate reservoir 22 by gas-liquid separation, recovering the gas product, injecting the liquid product into the geothermal reservoir 25 so that the liquid product is circulated with the heat-carrying fluid as in step S1.

The above method provided in the present invention utilizes heat-carrying fluid to transfer the energy in the geothermal reservoir 25 to the hydrate reservoir 22 to promote dissociation of natural gas hydrates. The method can realize cyclic utilization of the heat-carrying fluid while improving heat conduction efficiency, and has advantages including high recovery rate, low recovery cost, low energy loss, and high heat utilization efficiency, etc. It should be noted that the above description of the homocentric squares-shaped well structure may be reviewed to learn about the effect attained by the above method provided in the present invention.

Furthermore, the step S2 further comprises transferring the heat carried by the gas product to the heat-carrying fluid to be injected into the geothermal reservoir 25 in the gas product recovery process. Thus, the heat can be utilized efficiently and heat loss can be reduced.

In the present invention, the method may utilize the homocentric squares-shaped well structure described above. Of course, alternatively, the method may utilize any other structure or apparatus that can implement the method.

At last, it should be noted that the geothermal heat usually refers to the thermal energy in the rocks in the earth, thermal energy in geothermal fluids and associated components, which can be exploited and utilized economically by human. Generally speaking, the temperature increases as the depth increases, and the normal gradient of temperature rise is 25° C.–30° C./1,000 m. Research results have demonstrated that the reserve of geothermal resources is abundant, and geothermal resources not only are clean but also are renewable and can be used persistently, and have very high value in use. Therefore, with the homocentric squares-shaped well structure and method described above in the present invention, geothermal energy can be utilized to recover natural gas hydrates. The structure and method can overcome the drawbacks of high heat loss and high cost in the conventional heat shock method, and can improve the utilization efficiency of the resources.

While some preferred embodiments of the present invention are described above with reference to the accompanying drawings, the present invention is not limited to the details in those embodiments. Those skilled in the art can make modifications and variations to the technical scheme of the present invention, without departing from the spirit of the present invention. However, all these modifications and variations shall be deemed as falling into the scope of protection of the present invention.

In addition, it should be noted that the specific technical features described in above embodiments can be combined in any appropriate form, provided that there is no conflict. To avoid unnecessary repetition, the possible combinations are not described specifically in the present invention.

Moreover, different embodiments of the present invention can be combined freely as required, as long as the combinations don't deviate from the ideal and spirit of the present invention. However, such combinations shall also be deemed as falling into the scope disclosed in the present invention.

The invention claimed is:

1. A homocentric squares-shaped well structure for marine hydrate reserve recovery utilizing geothermal heat, comprising:

an injection well, arranged to extend from the ocean surface to a geothermal reservoir and configured to inject heat-carrying fluid;

a heat extraction well, disposed inside the geothermal reservoir and configured to convey the heat-carrying fluid so that the heat-carrying fluid extracts heat from the geothermal reservoir, an inlet end of the heat extraction well being in communication with an outlet end of the injection well;

a circulation well, arranged to extend from the geothermal reservoir to a hydrate reservoir, an inlet end of the circulation well being in communication with an outlet end of the heat extraction well;

a heat release and collection well, disposed in the hydrate reservoir and configured to release the heat-carrying fluid to the hydrate reservoir and collect dissociation products in the hydrate reservoir at the same time, an inlet end of the heat release and collection well being in communication with an outlet end of the circulation well; and a production pipeline, fitted in the injection well, wherein a radial clearance is formed between the production pipeline and the injection well, the production pipeline is arranged to extend from the ocean surface to the hydrate reservoir, an inlet end of the production pipeline extends out of the injection well and is in communication with an outlet end of the heat release and collection well, a gas-liquid separator is disposed in the production pipeline and is configured to block the direct communication between the inlet end and the outlet end of the production pipeline, an inlet of the gas-liquid separator is in communication with the inlet end of the production pipeline, a liquid outlet of the gas-liquid separator is in communication with the injection well, and a gas outlet of the gas-liquid separator is in communication with the outlet end of the production pipeline.

2. The homocentric squares-shaped well structure of claim 1, wherein a check valve is configured to prevent the gas from flowing back into the gas-liquid separator and is disposed in the production pipeline.

3. The homocentric squares-shaped well structure of claim 1, wherein the injection well and the circulation well are vertical wells.

4. The homocentric squares-shaped well structure of claim 3, wherein a central axis of the heat release and collection well is at a distance equal to ⅓-¼ of a thickness of the hydrate reservoir from a top surface of the hydrate reservoir.

5. The homocentric squares-shaped well structure of claim 1, wherein the heat extraction well and the heat release and collection well are horizontal wells.

6. The homocentric squares-shaped well structure of claim 5, wherein a central axis of the heat release and collection well is at a distance equal to ⅓-¼ of a thickness of the hydrate reservoir from a top surface of the hydrate reservoir.

7. The homocentric squares-shaped well structure of claim 1, wherein the heat extraction well and the heat release and collection well are both screen pipes.

8. The homocentric squares-shaped well structure of claim 1, wherein the homocentric squares-shaped well structure comprises a pressurizing device configured to provide circulation power for the heat-carrying fluid.

9. The homocentric squares-shaped well structure of claim 1, comprising an ocean platform disposed above the injection well, wherein the ocean platform is equipped with a processing station in communication with the outlet end of the production pipeline and a natural gas recovery bunker in communication with the processing station.

10. The homocentric squares-shaped well structure of claim 1, wherein an intermediate formation exists between the hydrate reservoir and the geothermal reservoir, and an insulating sleeve is fitted over the portion of the circulation well in the intermediate formation.

11. A method for marine hydrate reserve recovery utilizing geothermal heat, comprising the following steps:

S1: injecting heat-carrying fluid into a geothermal reservoir, and driving the heat-carrying fluid to extract heat from the geothermal reservoir and then flow to a hydrate reservoir, to promote dissociation of natural gas hydrates in the hydrate reservoir;

S2: treating the dissociation product in the hydrate reservoir by gas-liquid separation, recovering the gas product, injecting the liquid product into the geothermal reservoir so that the liquid product is circulated with the heat-carrying fluid as in step S1, the method is implemented in a homocentric squares-shaped well structure for marine hydrate reserve recovery utilizing geothermal heat, comprising:

an injection well, arranged to extend from the ocean surface to a geothermal reservoir and configured to inject heat-carrying fluid;

a heat extraction well, disposed inside the geothermal reservoir and configured to convey the heat-carrying fluid so that the heat-carrying fluid extracts heat from the geothermal reservoir, an inlet end of the heat extraction well being in communication with an outlet end of the injection well;

a circulation well, arranged to extend from the geothermal reservoir to a hydrate reservoir, an inlet end of the circulation well being in communication with an outlet end of the heat extraction well;

a heat release and collection well, disposed in the hydrate reservoir and configured to release the heat-carrying fluid to the hydrate reservoir and collect dissociation products in the hydrate reservoir at the same time, an inlet end of the heat release and collection well being in communication with an outlet end of the circulation well; and a production pipeline, fitted in the injection well, wherein a radial clearance is formed between the production pipeline and the injection well, the production pipeline is arranged to extend from the ocean surface to the hydrate reservoir, an inlet end of the production pipeline extends out of the injection well and is in communication with an outlet end of the heat release and collection well, a gas-liquid separator is disposed in the production pipeline and is configured to block the direct communication between the inlet end and the outlet end of the production pipeline, an inlet of the gas-liquid separator is in communication with the inlet end of the production pipeline, a liquid outlet of the gas-liquid separator is in communication with the injection well, and a gas outlet of the gas-liquid separator is in communication with the outlet end of the production pipeline.

12. The method of claim 11, wherein, the step S2 further comprises transferring the heat carried by the gas product to the heat-carrying fluid to be injected into the geothermal reservoir in the gas product recovery process.

* * * * *